US010636601B2

(12) United States Patent
Puhalla et al.

(10) Patent No.: US 10,636,601 B2
(45) Date of Patent: Apr. 28, 2020

(54) ELECTRICAL SWITCHING APPARATUS AND ADJUSTABLE TRIP ASSEMBLY THEREFOR

(71) Applicant: EATON CORPORATION, Cleveland, OH (US)

(72) Inventors: Craig Joseph Puhalla, Moon Township, PA (US); Mark Anthony Janusek, Bethel Park, PA (US); David Curtis Turner, Imperial, PA (US); Jonathan M. Peifer, Pittsburgh, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 457 days.

(21) Appl. No.: 15/641,776

(22) Filed: Jul. 5, 2017

(65) Prior Publication Data

US 2019/0013170 A1 Jan. 10, 2019

(51) Int. Cl.
*H01H 51/34* (2006.01)
*H01H 71/40* (2006.01)
(Continued)

(52) U.S. Cl.
CPC ..... *H01H 50/34* (2013.01); *H01H 50/02* (2013.01); *H01H 71/40* (2013.01);
(Continued)

(58) Field of Classification Search
CPC ..... H01H 50/34; H01H 50/02; H01H 71/40; H01H 71/7418; H01H 73/48; H01H 71/2472; H01H 2239/06
See application file for complete search history.

(56) References Cited

U.S. PATENT DOCUMENTS 2,047,739 A * 7/1936 Lingal ..... H01H 71/40 335/26
2,329,053 A * 9/1943 Jennings ..... H01H 71/40 335/23
(Continued)

FOREIGN PATENT DOCUMENTS

GB 709947 A * 6/1954 ..... H01R 13/453

OTHER PUBLICATIONS

European Patent Office, "Extended European Search Report" (corresp. to EP 18179853.9), dated Nov. 7, 2018, 6 pp.

*Primary Examiner* — Mohamad A Musleh
(74) *Attorney, Agent, or Firm* — Eckert Seamans Cherin & Mellott, LLC

(57) ABSTRACT

An adjustable trip assembly is for an electrical switching apparatus. The electrical switching apparatus includes a housing, separable contacts and an operating mechanism for opening and closing the separable contacts. The adjustable trip assembly includes a load conductor, a magnetic assembly comprising a magnetic member and an armature movably coupled to the magnetic member, and a calibration assembly comprising a calibration bracket cooperating with the armature, and an adjustment mechanism being adjustable to move the calibration bracket and thereby adjust the position of the armature with respect to the magnetic member to calibrate the magnetic assembly. The magnetic assembly further includes a biasing element that biases the armature away from the magnetic member.

16 Claims, 8 Drawing Sheets

(51) Int. Cl.

| | |
|---|---|
| ***H01H 73/48*** | (2006.01) |
| ***H01H 71/74*** | (2006.01) |
| ***H01H 50/34*** | (2006.01) |
| ***H01H 50/02*** | (2006.01) |
| *H01H 71/24* | (2006.01) |

(52) U.S. Cl.
CPC ..... *H01H 71/7418* (2013.01); *H01H 73/48* (2013.01); *H01H 71/2472* (2013.01); *H01H 2239/06* (2013.01)

(56) References Cited

U.S. PATENT DOCUMENTS

| | | | | | |
|---|---|---|---|---|---|
| 2,345,105 | A | * | 3/1944 | Dorfman | H01H 71/40 335/35 |
| 2,376,759 | A | * | 5/1945 | Dyer | C09K 3/185 335/39 |
| 2,574,093 | A | | 11/1951 | Edmunds | |
| 2,658,973 | A | * | 11/1953 | Casey | H01H 71/40 335/37 |
| 6,137,386 | A | | 10/2000 | Mueller | |
| 6,788,174 | B1 | | 9/2004 | Afshari et al. | |

* cited by examiner

ELECTRICAL SWITCHING APPARATUS AND ADJUSTABLE TRIP ASSEMBLY THEREFOR

BACKGROUND

Field

The disclosed concept relates generally to electrical switching apparatus and, more particularly, to electric switching apparatus, such as for example, circuit breakers. The disclosed concept also relates to adjustable trip assemblies for electrical switching apparatus.

Background Information

Electrical switching apparatus, such as molded case circuit breakers, generally include at least one pair of separable contacts which are operated either manually, by way of a handle disposed on the outside of the circuit breaker housing, or automatically by way of a trip unit in response to a trip condition (e.g., without limitation, an overcurrent condition; a relatively high level short circuit or fault condition; a ground fault or arc fault condition).

Relatively small molded case circuit breakers, for example, that are used in residential and light industrial applications, typically include a thermal-magnetic trip unit having a thermal trip assembly and a magnetic trip assembly. The thermal trip assembly includes a number of heater elements and a bimetal. In operation, for example in response to an overload condition, electric current drawn by the load heats the heater elements which, in turn, heat the bimetal causing it to bend and cooperate, directly or indirectly, with a trip bar of the circuit breaker operating mechanism to open (e.g., separate) the separable contacts of the circuit breaker and interrupt the flow of electric current. Thus, the thermal trip assembly functions to provide a thermal trip response that is directly related to the magnitude of current drawn by the load. The magnetic trip assembly is structured to react to a magnetic field generated, for example, by an overcurrent condition, thereby providing a relatively more rapid magnetic trip response. Typically, the reaction to the magnetic field is in the form of a movement of an armature of the magnetic trip assembly which, in turn, cooperates, directly or indirectly, with the trip bar of the circuit breaker operating mechanism to trip open the separable contacts.

Calibration or adjustment of known trip assemblies, for example to cause the magnetic tripping operation to occur at a different predetermined current level, can be difficult or cause issues. For example, bending or damage of parts or components can occur.

There is, therefore, room for improvement in electrical switching apparatus and in adjustable trip assemblies therefor.

SUMMARY

These needs and others are met by embodiments of the disclosed concept, which are directed to an adjustable trip assembly for electrical switching apparatus.

As one aspect of the disclosed concept, an adjustable trip assembly is provided for an electrical switching apparatus. The electrical switching apparatus includes a housing, separable contacts and an operating mechanism for opening and closing the separable contacts. The adjustable trip assembly comprises: a load conductor; a magnetic assembly comprising a magnetic member and an armature movably coupled to the magnetic member; and a calibration assembly comprising a calibration bracket cooperating with the armature, and an adjustment mechanism being adjustable to move the calibration bracket and thereby adjust the position of the armature with respect to the magnetic member to calibrate the magnetic assembly.

The magnetic assembly may further comprise a biasing element. The biasing element may bias the armature away from the magnetic member.

An electrical switching apparatus including the aforementioned adjustable trip assembly is also disclosed.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
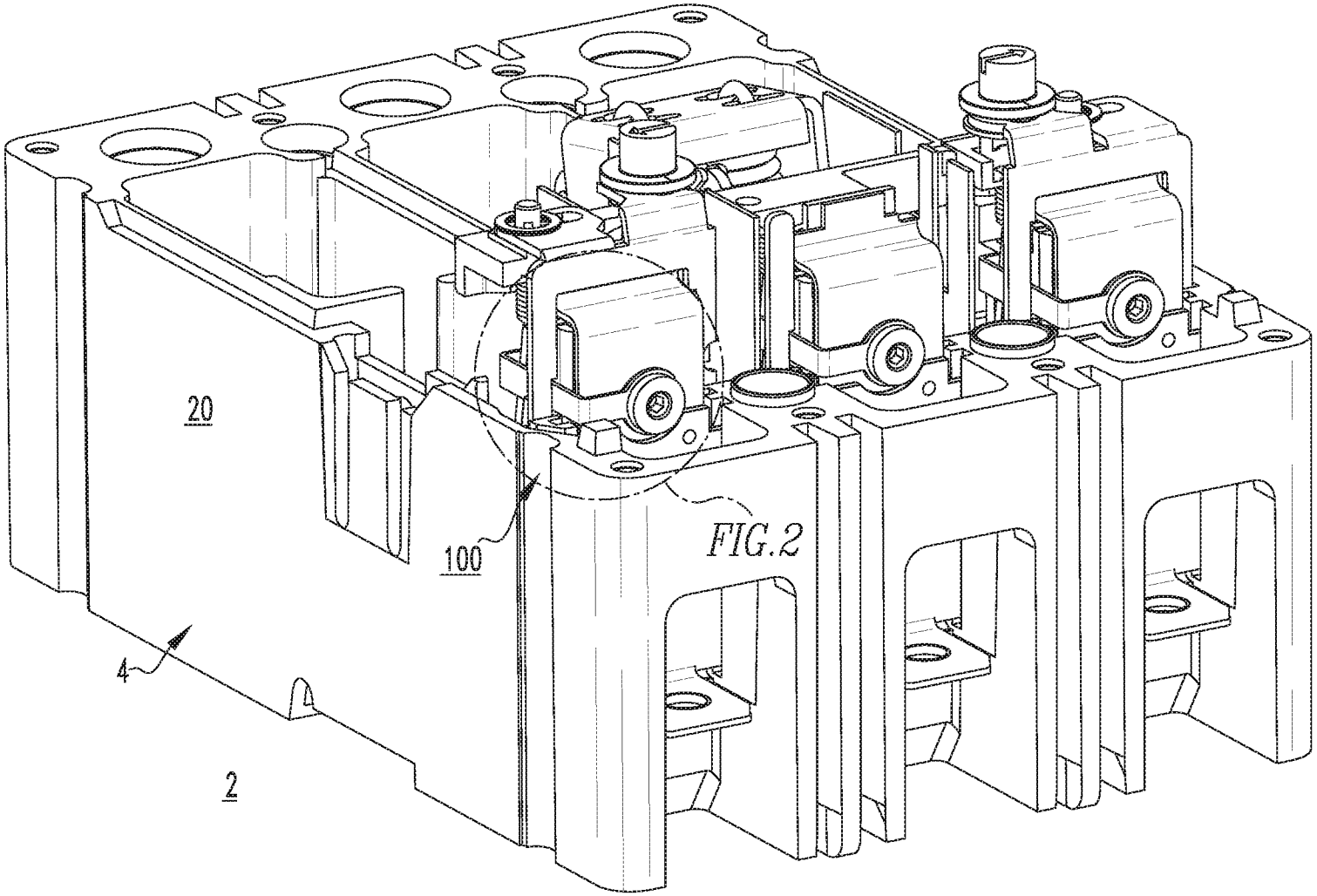
FIG. 1 is an isometric view of an electrical switching apparatus and an adjustable trip assembly therefor, in accordance with an embodiment of the disclosed concept, with a portion of the housing removed to show internal components.

Directional phrases used herein, such as, for example, left, right, front, back, top, bottom and derivatives thereof, relate to the orientation of the elements shown in the drawings and are not limiting upon the claims unless expressly recited therein. It is to be understood that the specific elements illustrated in the drawings and described in the following specification are simply exemplary embodiments of the disclosed concept. Therefore, specific orientations and other physical characteristics related to the embodiments disclosed herein are not to be considered limiting with respect to the scope of the disclosed concept.

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrases "directly connected" or "directly electronically connected" shall mean that two or more parts are joined together directly, without any intermediate parts being disposed therebetween at the point or location of the connection.

As employed herein, the phrase "electrically connected" shall mean that two or more parts or components are joined together either directly or joined through one or more intermediate parts such that electricity, current, voltage, and/or energy is operable to flow from one part or component to the other part or component, and vice versa.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

Figure 6:
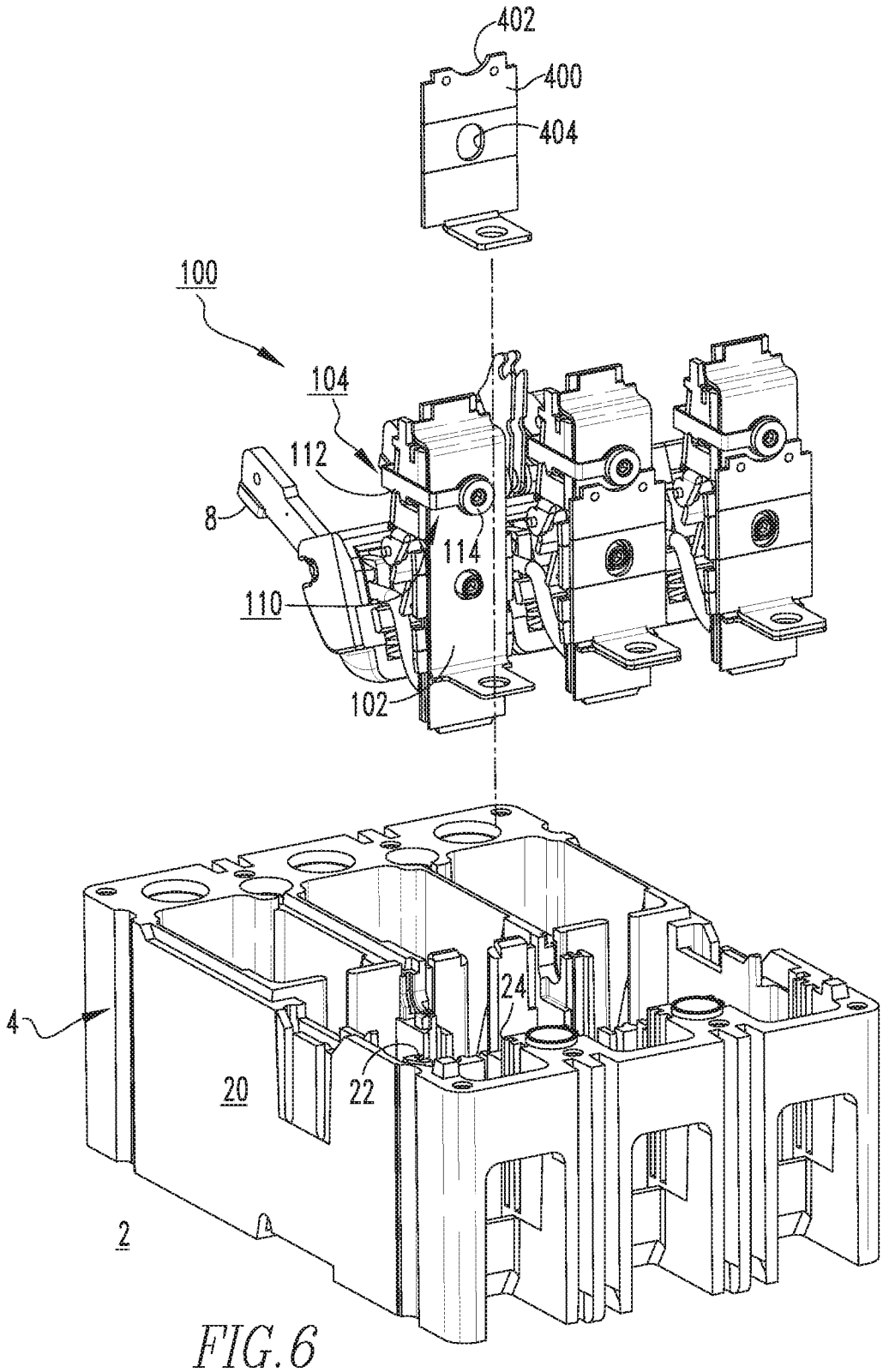
FIG. 6 is an exploded isometric view of the electrical switching apparatus and adjustable trip assembly therefor of FIG. 1.
Figure 7:
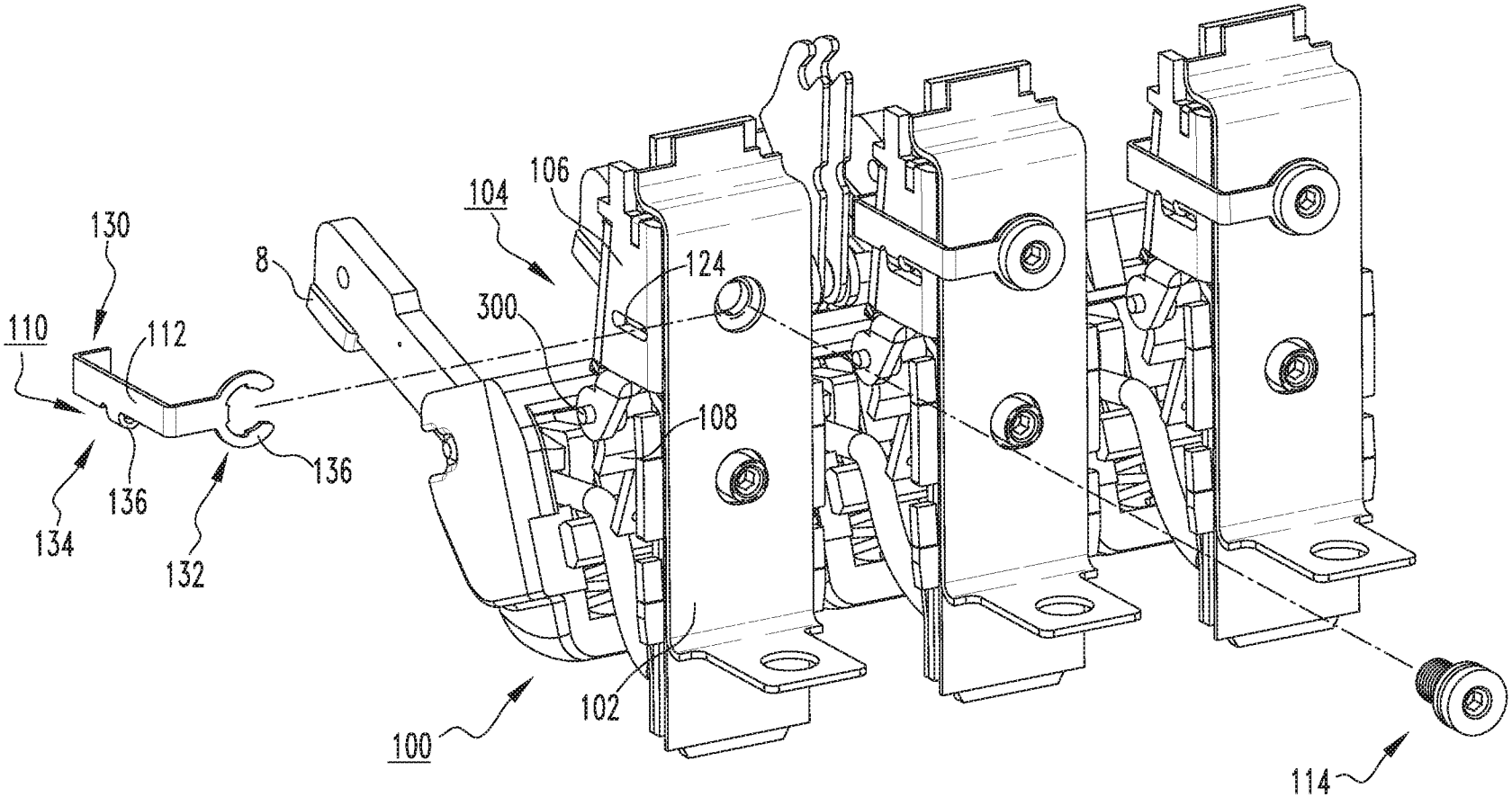
FIG. 7 is a partially exploded isometric view of a portion of the electrical switching apparatus and adjustable trip assembly therefor of FIG. 6.
Figure 8:
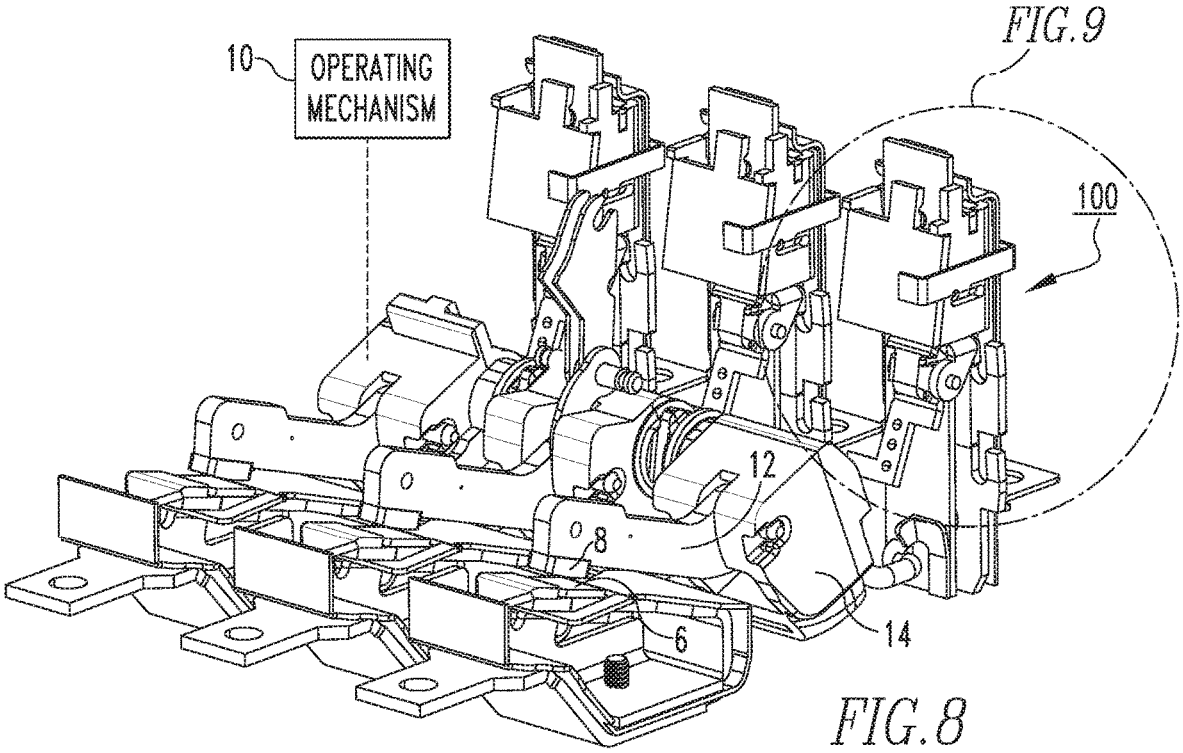
FIG. 8 is an assembled isometric view of the portion of the electrical switching apparatus and adjustable trip assembly therefor of FIG. 7.

FIG. 1 shows an electrical switching apparatus, such as for example and without limitation, a molded case circuit breaker 2, which employs an adjustable trip assembly 100 in accordance with a non-limiting example embodiment of the disclosed concept. In the example of FIG. 1, the circuit breaker 2 includes a housing 4, separable contacts 6,8 enclosed by the housing, and an operating mechanism 10 (shown in simplified form in FIG. 8) for opening and closing the separable contacts 6,8 (both shown in FIG. 8). More specifically, the separable contacts 6,8 include a stationary contact 6 and a movable contact 8, which is disposed on a corresponding movable (e.g., pivotable) contact arm 12 (FIGS. 6, 7 and 8). As best shown in FIG. 8, the movable contact arm 12 extends outwardly from a cross bar 14 and is pivotable with the cross bar 14 in a well known manner, for example, in response to a trip condition. The example circuit breaker 2 is a multi-pole circuit breaker including a plurality of poles (three are shown in the non-limiting example of FIG. 1). However, it will be appreciated that any known or suitable alternative electrical switching apparatus (not shown) having any known or suitable number of poles could be employed, without departing from the scope of the disclosed concept. It will further be appreciated that for ease of illustration and economy of disclosure, components of the disclosed concept will generally be described with respect to only one of the poles of the circuit breaker 2.

Figure 2:
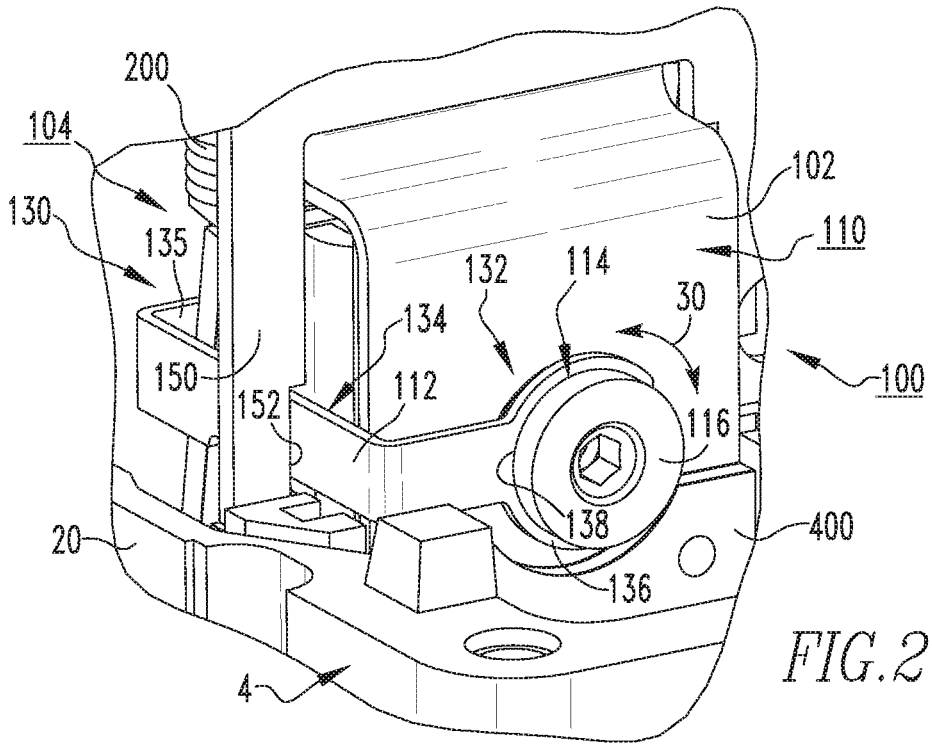
FIG. 2 is an enlarged isometric view of a portion of the adjustable trip assembly of FIG. 1.
Figure 3:
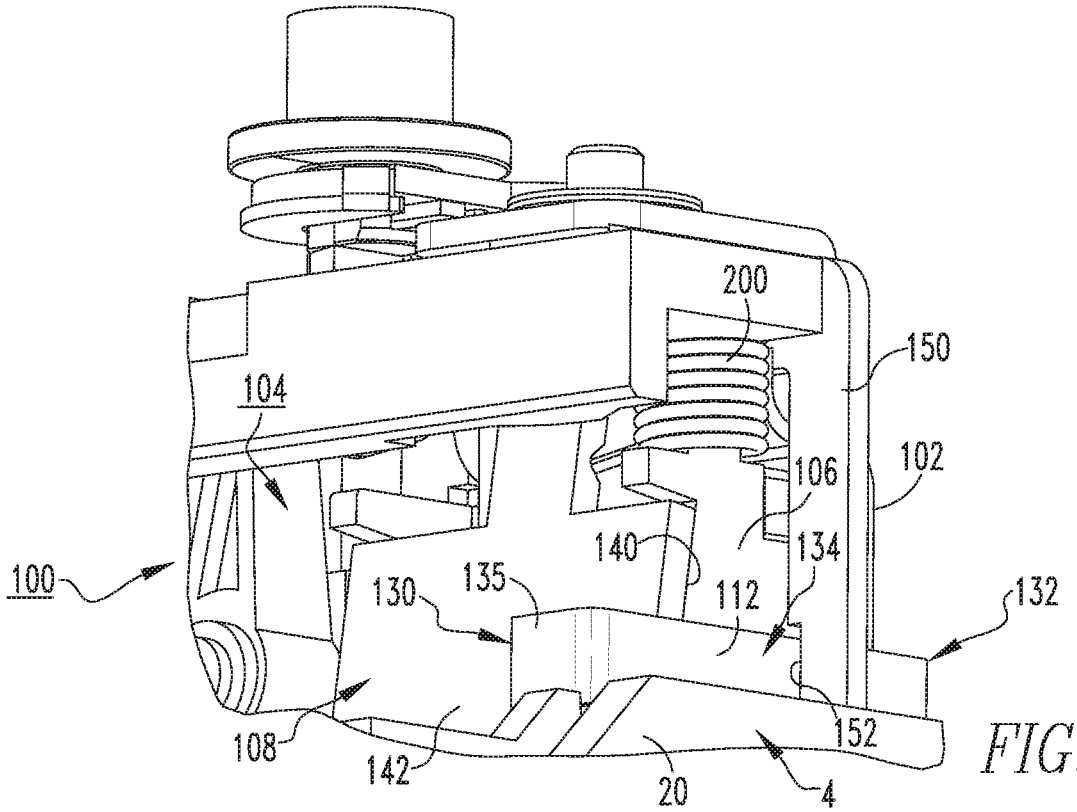
FIG. 3 is another enlarged isometric view of the adjustable trip assembly of FIG. 1.
Figure 9:
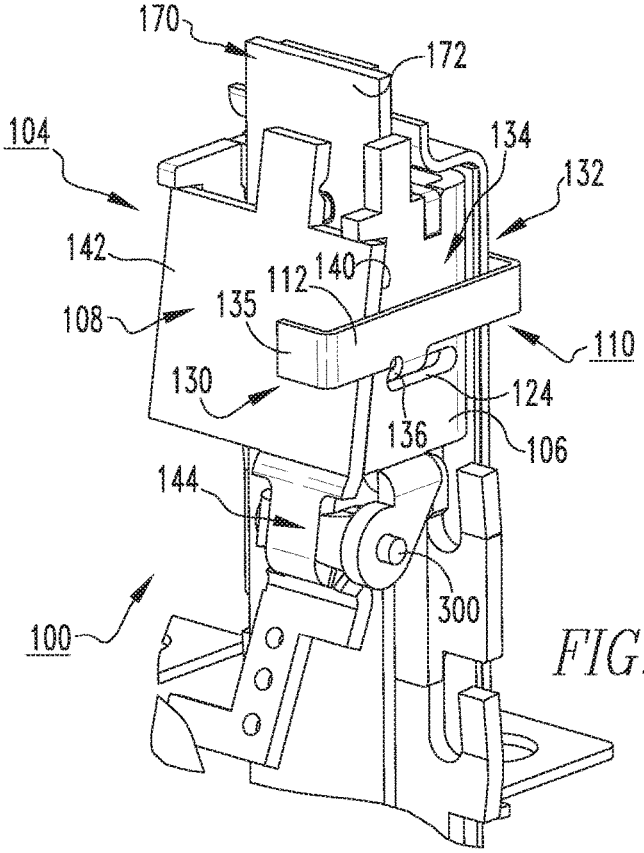
FIG. 9 is an enlarged isometric view of a portion of the adjustable trip assembly of FIG. 8.

FIGS. 2 and 3 show front and back isometric views, respectively, of the adjustable trip assembly 100. In the example shown, the adjustable trip assembly 100 includes a load conductor 102, a magnetic assembly 104, and a calibration assembly 110. The magnetic assembly 104 includes a magnetic member 106 and an armature 108 movably coupled to the magnetic member 106, as best shown in FIG. 9. The calibration assembly 110 includes a calibration bracket 112, which cooperates with the armature 108, and an adjustment mechanism 114. The adjustment mechanism 114, which in the example shown and described herein is a magnetic calibration screw, is adjustable (e.g., rotatable clockwise or counterclockwise (from the perspectives of FIGS. 2 and 5) in the direction of arrow 30 of FIGS. 2 and 5) to move the calibration bracket 112 and thereby adjust the position of the armature 108 with respect to the magnetic member 106 to calibrate the magnetic assembly 104. Thus, it will be appreciated that the adjustable assembly 100 can be employed to relatively quickly and easily adjust the magnetic air gap (i.e., space or gap between the magnetic member 106 and the armature 108), without requiring bending or other possible deformation or damage of assembly components.

Figure 4:
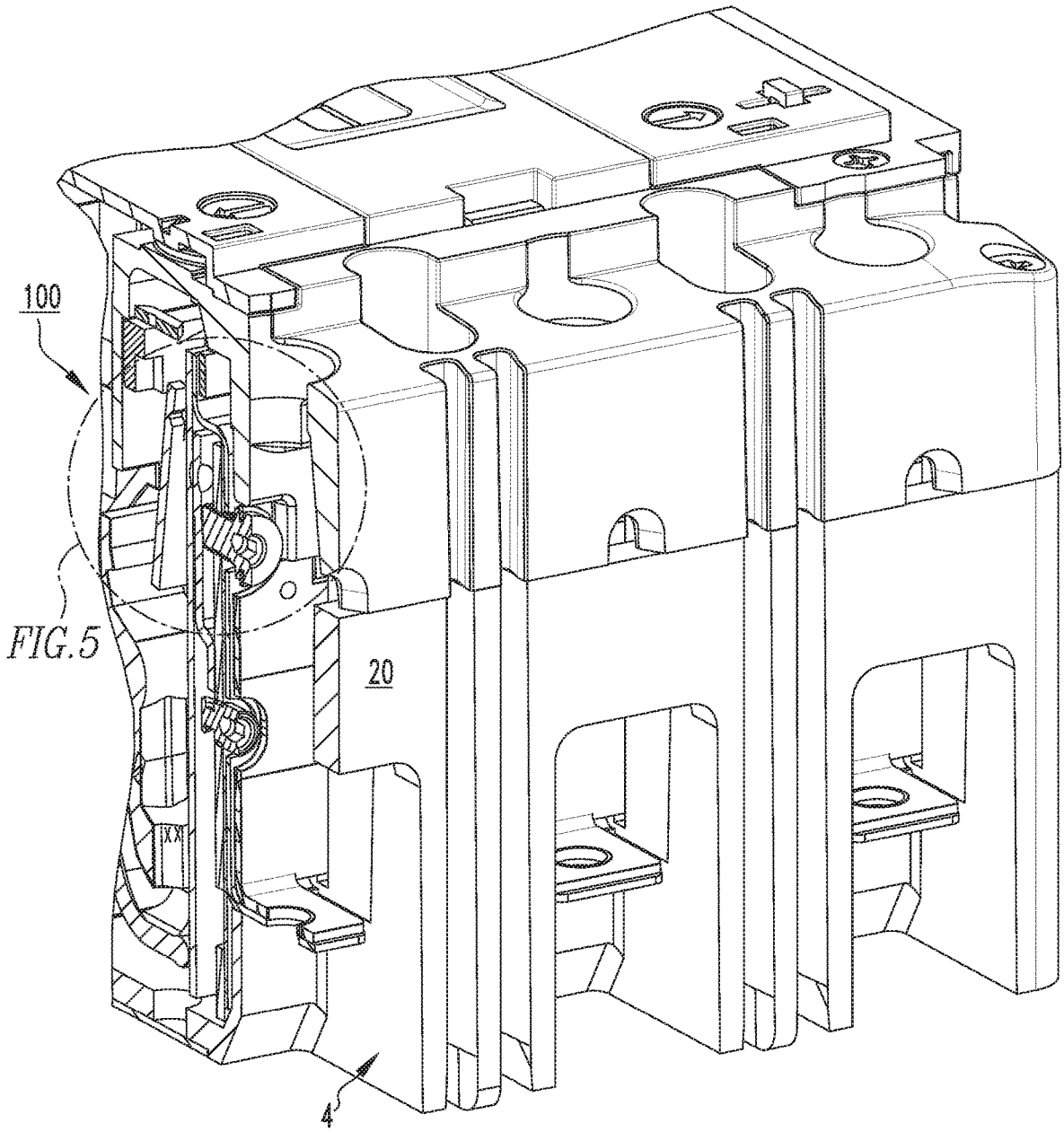
FIG. 4 is an isometric partially in section view of a portion of the electrical switching apparatus and adjustable trip assembly therefor of FIG. 1, also showing the cover of the housing.
Figure 5:
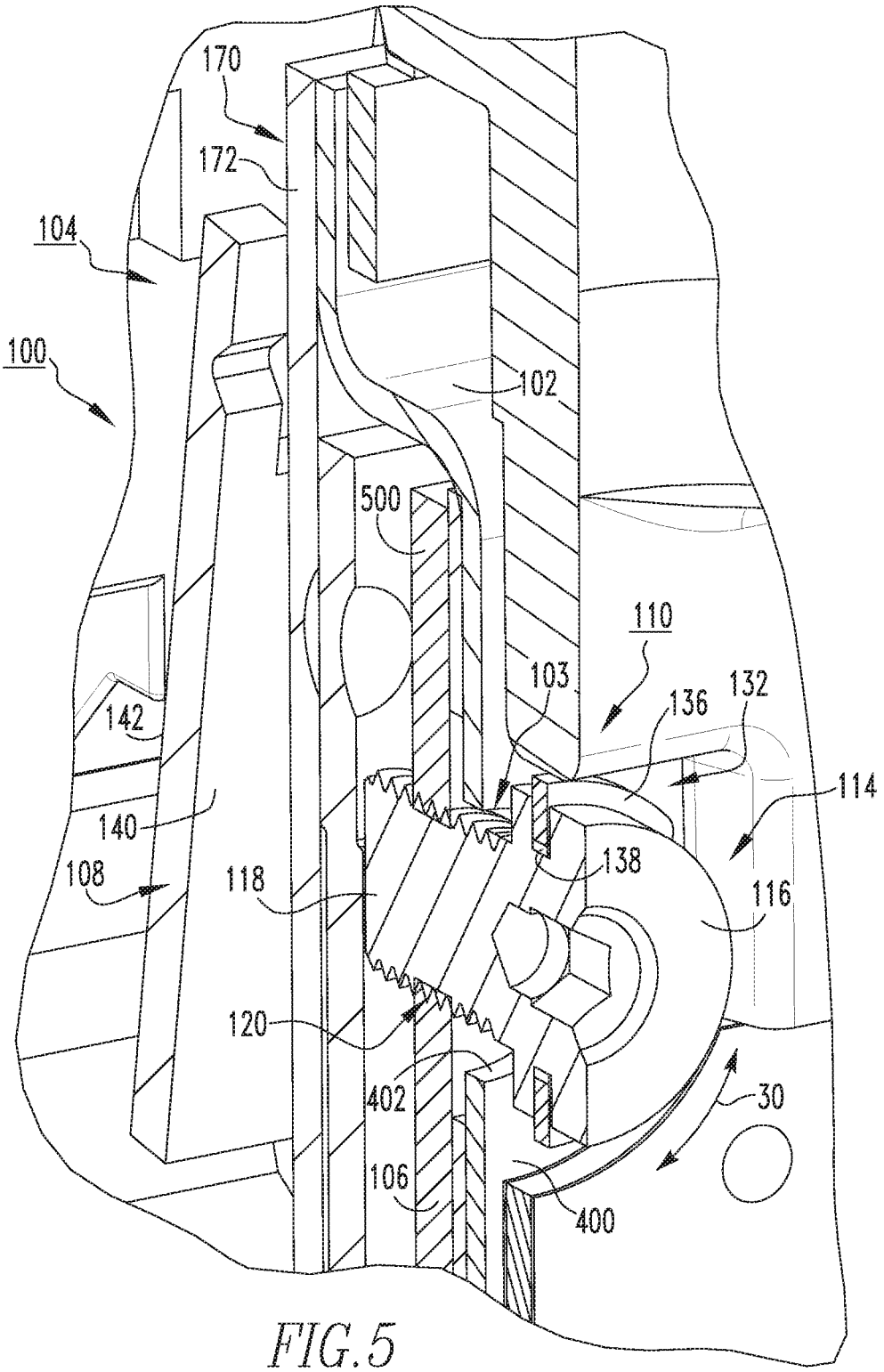
FIG. 5 is an enlarged view of a portion of the adjustable trip assembly of FIG. 4.

As shown in the section views of FIGS. 4 and 5, the magnetic calibration screw 114 includes an enlarged head portion 116 and the threaded body portion 118. The magnetic member 106 includes at least one threaded aperture (the example magnetic member 106 shown and described herein includes a first threaded aperture 120 and a second threaded aperture 122 (both shown in FIGS. 4 and 10)). The threaded body portion 118 of the magnetic calibration screw 114 is adjustably secured within the first threaded aperture 120, as shown. Accordingly, it will be appreciated that the aforementioned adjustment will result in the movement of the magnetic calibration screw 114 with respect to the magnetic member 106, and will also result in corresponding movement of the calibration bracket 112 of the calibration assembly 110 to effectuate calibration of the magnetic assembly 104, as will now be described with reference to FIGS. 6-10.

The calibration bracket 112 of the example calibration assembly 110 is preferably a non-ferrous member. As best shown in the exploded views of FIGS. 7 and 10, the calibration bracket 112 includes a first end 130, a second end 132, and an intermediate portion 134 extending therebetween. The first end 130 engages the armature 108, as best shown in FIGS. 8 and 9. The second end 132 cooperates with the enlarged head 116 of the calibration screw 114 (best shown in FIGS. 2, 4 and 5). More specifically, the second end 132 of the calibration bracket 112 in the non-limiting example embodiment shown and described herein comprises a generally C-shaped clip portion 136, and the enlarged head portion 116 of the magnetic calibration screw 114 includes a corresponding annular groove 138. The C-shaped clip portion 136 extends into the annular groove 138 (best shown in the enlarged section view of FIG. 5) to secure (e.g., clip) the calibration bracket 112 to the magnetic calibration screw 114. It will be appreciated, therefore, that movement of the magnetic calibration screw 114 will result in corresponding movement of the calibration bracket 112 and, in turn, movement of the armature 108.

In addition to the aforementioned C-shaped clip portion 136, the example calibration bracket 112 includes a lateral projection 136, which extends outwardly from the intermediate portion 134 of the calibration bracket 112, as shown. Such lateral projection 136 is movably disposed in an elongated aperture (e.g., slot) in the side of the magnetic member 106 (see, for example, FIGS. 8 and 9). The first end 130 of the calibration bracket 112 includes a lateral flange 135, which engages the armature 108, as previously described. More specifically, the armature 108 includes a first side 140 facing the magnetic member 106, a second side 142 opposite the first side 140, and a mounting portion 144, which is structured to pivotably couple the armature 108 to the magnetic member 106. In the example shown and described herein, the mounting portion 144 of the armature 108 is pivotably coupled to a corresponding portion of the magnetic member 106 by way of a pin member 300 (best shown in FIG. 10).

The magnetic assembly 104 further includes a biasing element 200 (see, for example and without limitation, spring 200 of FIGS. 2 and 3), which is structured to bias the armature 108 away from the magnetic member 106. That is, the lateral flange 135 of the first end 130 of the calibration bracket 112 engages the second side 142 of armature 108 to hold the armature 108 against the bias of the biasing element 200. Accordingly, in operation, adjusting (e.g., turning) the calibration screw 114 in a first direction (e.g., counterclockwise from the perspectives of FIGS. 2 and 5) will result in the lateral flange 135 pulling the armature 108 toward the magnetic member 106 against the bias of the biasing element 200, thereby reducing the air gap between the armature 108 and the magnetic member 106. Adjusting or turning the magnetic calibration screw 114 in a second direction (e.g., clockwise from the perspectives of FIGS. 2 and 5), which is opposite the first direction, will result in the lateral flange 135 moving to relax pressure on the second side 142 of the armature 108 to permit the bias of the biasing element 200 to push the armature 108 away from the magnetic member 106, thereby increasing the air gap between the armature 108 and the magnetic member 106.

Referring again to FIGS. 1 and 2, in the example shown, the adjustable trip assembly 100 further includes a magnetic adjust bracket 150, which has a guide aperture 152. The intermediate portion of the calibration bracket 112 extends through the guide aperture 152. The molded base 20 of the circuit breaker housing 4 includes a number of guide slots 22,24 (best shown in the exploded view of FIG. 6). The guide slots 22,24 are structured to respectively receive corresponding sides of the magnetic adjust bracket 150 (not shown in FIG. 6). Accordingly, it will be appreciated that the guide slots 22,24 (FIG. 6) help to guide and correctly position the adjustable trip assembly 100 and magnetic adjust bracket 150 therefor within the within the molded base 20, as shown in FIG. 1.

Figure 10:
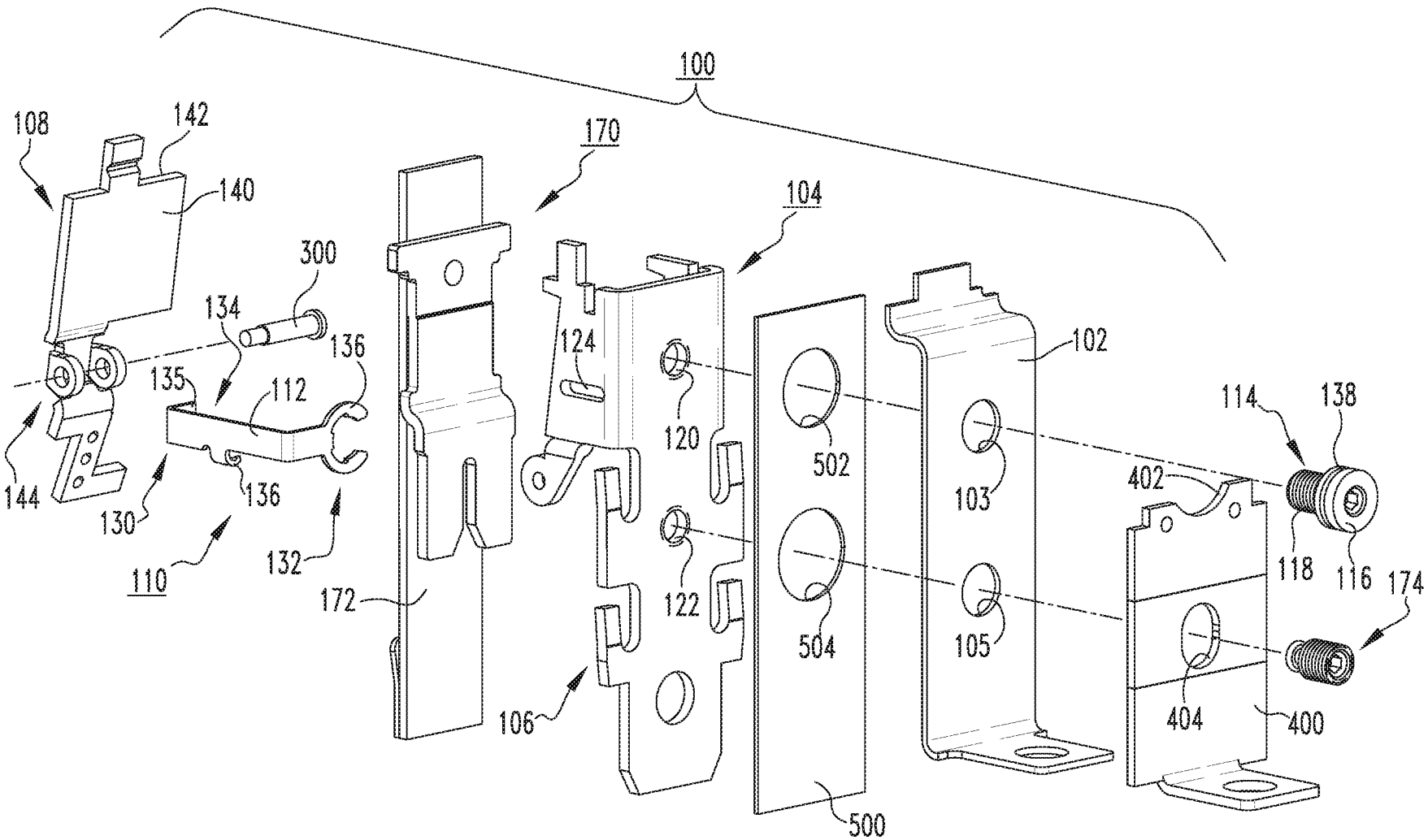
FIG. 10 is an exploded isometric view of the adjustable trip assembly of FIG. 9.

As shown FIGS. 6 and 10, the example adjustable trip assembly 100 preferably further includes a shim 400. The shim 400 is disposed between the load conductor 102 and the housing 4 of the circuit breaker 2, when the trip assembly 100 is installed within the molded base 20 of the circuit breaker 2. Among other functions, the shim 400 serves to correctly position and secure the trip assembly 100 and, in particular, the corresponding load conductor 102 within the molded base 20 of the circuit breaker housing 4. Preferably, the shim 400 is made from an electrically conductive material (e.g., without limitation, copper) in order to suitably conduct electrical current. As shown, the shim 400 includes a cutout portion 402, which provides clearance for the calibration bracket 112 and/or calibration screw 114 (see also FIGS. 2 and 5). The example shim 400 also includes a thru hole 404, which accommodates a threaded thermal calibration screw 174, as will now be described.

Continuing to refer to FIG. 10, it will be appreciated that the adjustable trip assembly 100 in the non-limiting example shown and described herein, further includes a thermal assembly 170 having a heater element 172 as well as the aforementioned threaded thermal calibration screw 174. The heater element 172 is disposed between the armature 108 and the magnetic member 106. As previously described, the magnetic member 106 includes first and second threaded apertures 120,122. The load conductor 102 includes first and second thru holes 103,105 and an optional insulator 500 (e.g., without limitation fish paper). Such insulator 500 is not required, however, when it is employed it is preferably disposed between the magnetic member 106 and the load conductor 102. The insulator 500 also includes first and second thru holes 502,504. The magnetic calibration screw 114 extends through the first thru hole 103 of the load conductor 102, through the thru hole 502 of the optional insulator 500, and threadably engages the first threaded aperture 120 of the magnetic member 106. The threaded thermal calibration screw 174 extends through the thru hole 404 of the shim 400, through the second thru hole 105 of the load conductor 102 and the corresponding thru hole 504 of the optional insulator 500, and finally through the second threaded aperture 122 of the magnetic member 106 where it engages the heater element 172 on the opposite side of the magnetic member 106. It will be appreciated that the thermal calibration screw 174 is adjustable (e.g., pivotable clockwise or counterclockwise) in a generally similar manner to the magnetic calibration screw 114, previously described, to adjust (e.g., move) the heater element 172 and thereby calibrate the thermal assembly 170.

Accordingly, it will be appreciated that the disclosed adjustable trip assembly 100 provides an effective mechanism for relatively quickly and easily changing the magnetic calibration of the circuit breaker 2, while overcoming known disadvantages of the prior art (e.g., bending or other deformation or damage of assembly components). In addition, in at least one non-limiting example embodiment, the adjustable trip assembly 100 also provides for relatively quick and easy thermal calibration of the circuit breaker 2.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An adjustable trip assembly for an electrical switching apparatus, said electrical switching apparatus including a housing, separable contacts and an operating mechanism for opening and closing said separable contacts, said adjustable trip assembly comprising:

a load conductor;

a magnetic assembly comprising a magnetic member and an armature movably coupled to said magnetic member; and a calibration assembly comprising a calibration bracket cooperating with said armature, and an adjustment mechanism being adjustable to move said calibration bracket and thereby adjust the position of said armature with respect to said magnetic member to calibrate said magnetic assembly, wherein said adjustment mechanism is a magnetic calibration screw comprising an enlarged head portion and a threaded body portion; wherein said magnetic member includes a threaded aperture; and wherein said threaded body portion of said magnetic calibration screw is adjustably secured within the threaded aperture, and wherein said calibration bracket is a non-ferrous member including a first end, a second end, and an intermediate portion extending between the first end and the second end; wherein the first end engages said armature; and wherein the second end cooperates with the enlarged head portion of said calibration screw.

2. The adjustable trip assembly of claim 1 wherein said magnetic member includes an elongated aperture; and wherein the intermediate portion of said calibration bracket includes a lateral projection movably disposed in said elongated aperture.

3. The adjustable trip assembly of claim 1 wherein the second end of said calibration bracket comprises a C-shaped clip portion; wherein the enlarged head portion of said magnetic calibration screw includes an annular groove; and wherein the C-shaped clip portion of said calibration bracket extends into the annular groove to secure said calibration bracket to said magnetic calibration screw.

4. The adjustable trip assembly of claim 1 wherein said armature includes a first side facing said magnetic member, a second side opposite the first side, and a mounting portion structured to pivotably couple said armature to said magnetic member; wherein said magnetic assembly further comprises a biasing element; and wherein said biasing element biases said armature away from said magnetic member.

5. The adjustable trip assembly of claim 4 wherein the first end of said of said calibration bracket includes a lateral flange; wherein said lateral flange engages the second side of said armature; wherein said magnetic calibration screw is adjustable in a first direction resulting in said flange pulling said armature toward said magnetic member against the bias of said biasing element; and wherein said magnetic calibration screw is adjustable in a second direction resulting in said lateral flange moving to permit the bias of said biasing element to push said armature away from said magnetic member.

6. The adjustable trip assembly of claim 1 wherein said magnetic assembly further comprises a magnetic adjust bracket; wherein said magnetic adjust bracket includes a guide aperture; and wherein the intermediate portion of said calibration bracket extends through said guide aperture.

7. The adjustable trip assembly of claim 1 further comprising a shim structured to be disposed between said load conductor and the housing of said electrical switching apparatus; and wherein said shim includes a cutout portion providing clearance for said calibration bracket and said calibration screw.

8. The adjustable trip assembly of claim 7 further comprising a thermal assembly including a heater element and a threaded thermal calibration screw; wherein said heater element is disposed between said armature and said magnetic member; wherein said magnetic member includes a first threaded aperture and a second threaded aperture; wherein said load conductor includes a first thru hole and a second thru hole; wherein said shim further includes a thru hole; wherein said magnetic calibration screw extends through the first thru hole of said load conductor and threadably engages the first threaded aperture of said magnetic member; wherein said threaded thermal calibration screw extends through the thru hole of said shim, through the second thru hole of said load conductor, and through the second threaded aperture of said magnetic member to engage said heater element; and wherein said threaded thermal calibration screw is adjustable to adjust said heater element and thereby calibrate said thermal assembly.

9. The adjustable trip assembly of claim 1 wherein said magnetic assembly further comprises an insulator disposed between said magnetic member and said load conductor.

10. An electrical switching apparatus comprising:

a housing;

separable contacts enclosed by the housing;

an operating mechanism for opening and closing said separable contacts; and an adjustable trip assembly comprising:

a load conductor, a magnetic assembly comprising a magnetic member and an armature movably coupled to said magnetic member, and a calibration assembly comprising a calibration bracket cooperating with said armature, and an adjustment mechanism being adjustable to move said calibration bracket and thereby adjust the position of said armature with respect to said magnetic member to calibrate said magnetic assembly, wherein said adjustment mechanism is a magnetic calibration screw comprising an enlarged head portion and a threaded body portion; wherein said magnetic member includes a threaded aperture; and wherein said threaded body portion of said magnetic calibration screw is adjustably secured within the threaded aperture, and wherein said calibration bracket is a non-ferrous member including a first end, a second end, and an intermediate portion extending between the first end and the second end; wherein the first end engages said armature; and wherein the second end cooperates with the enlarged head portion of said calibration screw.

11. The electrical switching apparatus of claim 10 wherein said magnetic member includes an elongated aperture; and wherein the intermediate portion of said calibration bracket includes a lateral projection movably disposed in said elongated aperture.

12. The electrical switching apparatus of claim 10 wherein the second end of said calibration bracket comprises a C-shaped clip portion; wherein the enlarged head portion of said magnetic calibration screw includes an annular groove; and wherein the C-shaped clip portion of said calibration bracket extends into the annular groove to secure said calibration bracket to said magnetic calibration screw.

13. The electrical switching apparatus of claim 10 wherein said armature includes a first side facing said magnetic member, a second side opposite the first side, and a mounting portion structured to pivotably couple said armature to said magnetic member; wherein said magnetic assembly further comprises a biasing element; and wherein said biasing element biases said armature away from said magnetic member; wherein the first end of said of said calibration bracket includes a lateral flange; wherein said lateral flange engages the second side of said armature; wherein said magnetic calibration screw is adjustable in a first direction resulting in said flange pulling said armature toward said magnetic member against the bias of said biasing element; and wherein said magnetic calibration screw is adjustable in a second direction resulting in said lateral flange moving to permit the bias of said biasing element to push said armature away from said magnetic member.

14. The electrical switching apparatus of claim 10 wherein said magnetic assembly further comprises a magnetic adjust bracket; wherein said magnetic adjust bracket includes a guide aperture; wherein the intermediate portion of said calibration bracket extends through said guide aperture; wherein the housing of said electrical switching apparatus comprises a molded base having a number of guide slots; and wherein said magnetic adjust bracket is structured to be received within said guide slots.

15. The electrical switching apparatus of claim 10 further comprising a thermal assembly and a shim; said shim being disposed between said load conductor and the housing of said electrical switching apparatus; wherein said thermal assembly includes a heater element and a threaded thermal calibration screw; wherein said heater element is disposed between said armature and said magnetic member; wherein said magnetic member includes a first threaded aperture and a second threaded aperture; wherein said load conductor includes a first thru hole and a second thru hole; wherein said cutout portion of said shim wherein said shim provides clearance for said calibration bracket and said calibration screw; wherein said magnetic calibration screw extends through the first thru hole of said load conductor and threadably engages the first threaded aperture of said magnetic member; wherein said threaded thermal calibration screw extends through the thru hole of said shim, through the second thru hole of said load conductor, and through the second threaded aperture of said magnetic member to engage said heater element; and wherein said threaded thermal calibration screw is adjustable to adjust said heater element and thereby calibrate said thermal assembly.

16. The electrical switching apparatus of claim 10 wherein said magnetic assembly further comprises an insulator disposed between said magnetic member and said load conductor.

* * * * *